United States Patent [19]

Whittaker et al.

[11] 4,023,900

[45] May 17, 1977

[54] VARIABLE SPEED LIQUID DEVELOPMENT ELECTROSTATOGRAPHICS APPARATUS

[75] Inventors: Gary L. Whittaker; Cheryl A. Hess, both of Penfield, N.Y.

[73] Assignee: Xerox Corporation, Stamford, Conn.

[22] Filed: July 18, 1975

[21] Appl. No.: 597,045

Related U.S. Application Data

[62] Division of Ser. No. 236,934, March 22, 1972, abandoned.

[52] U.S. Cl. ..... 355/10; 118/DIG. 23; 427/15

[51] Int. Cl.[2] ..... G03G 15/10

[58] Field of Search ..... 355/10, 80; 96/1 LY; 118/6, DIG. 23; 427/15, 17; 354/298

[56] References Cited

UNITED STATES PATENTS

| | | | |
|---|---|---|---|
| 1,895,760 | 1/1933 | Hunt | 354/298 |
| 2,296,048 | 9/1942 | Planskoy | 354/298 |
| 3,316,875 | 5/1967 | Murray et al. | 118/6 |
| 3,667,428 | 6/1972 | Smith | 355/10 X |
| 3,712,728 | 1/1973 | Whittaker | 355/10 |
| 3,817,748 | 6/1974 | Whittaker | 96/1 LY |

*Primary Examiner*—Richard L. Moses
*Attorney, Agent, or Firm*—James J. Ralabate; Ernest F. Chapman

[57] ABSTRACT

A system is provided for the production of an electrostatographic copy of an original comprising:

a. means for forming an electrostatic latent image on an electrostatographic surface;
b. means for bringing the electrostatic image into developing configuration with a patterned applicator containing polar liquid developer to produce a developed image; and
c. means for varying the contact time between said electrostatic image and said liquid developer applicator to thereby change the amount of liquid developer deposited on the surface areas of relatively low potential without significantly affecting the amount of liquid developer deposited in areas of relatively high potential.

By variation of the time allowed for development, contrast variations in the developed image can be provided over a range of development speeds without a significant variation in the maximum density of the developed image.

9 Claims, 4 Drawing Figures

PRINT DENSITY
1.2
1.0
.8
.6
.4
.2
0
0.01
0.1
1.0
RECIPROCAL DEVELOPMENT SPEED [SEC/IN]
A
B
C
D
E
PLATE POTENTIAL
A - 100 VOLTS
B - 200 VOLTS
C - 300 VOLTS
D - 400 VOLTS
E - 500 VOLTS 10
11
12
13
14
15
16
17
18
19
20
21
22
23
24
24a
24b
25
26
27
28
29
30
31
32
33
34
34a
35
36
37

VARIABLE SPEED LIQUID DEVELOPMENT ELECTROSTATOGRAPHICS APPARATUS

This is a division, of application Ser. No. 236,934, filed Mar. 22, 1972 now abondoned.

This invention relates, in general, to electrostatographic reprodcution and, in particular, to apparatus and methods for varying contrast of electrostatographic prints without significant variation in maximum print density.

The formation and development of images by electrostatic means is well known. The basic electrostatographic process, as taught by C. F. Carlson in U.S. Pat. No. 2,297,691, involves placing a uniform electrostatic charge on a photoconductive insulating layer, exposing the layer to a light-and-shadow image to dissipate the charge on the areas of the layer exposed to the light and developing the resultant imaged photoconductive layer by bringing the latter into developing configuration with a finely-divided electroscopic powder referred to in the art as "toner". When a toner having the opposite polarity of the charged layer is employed, the toner is attracted to those areas of the layer which retain charge, thereby producing a positive print if the original subject matter is in the positive form. By employing a toner of the same polarity as the charged layer, a negative print is correspondingly produced. This toner image may be transferred to a receiving surface such as paper and affixed thereto by heat, when the photoconductive layer is reusable; or directly affixed to the photoconductive layer, if a non-reusable photoconductor is employed. Instead of latent image formation, by exposing a uniformly charged photoconductive layer to a light-and shadow image, one may form the latent image by directly charging an insulating layer in image configuration, and then developing the latent image with toner, if elimination of the need to uniformly charge the photoconductive layer is desired.

Many development techniques are known for rendering the trostatic latent image visible. These include "cascade" development disclosed by E. N. Wise in U.S. Pat. No. 2,618,552; "powder cloud" development disclosed by C. F. Carlson in U.S. Pat. No. 2,221,776, and "magnetic brush" development disclosed in U.S. Pat. No. 2,874,063.

Development of a electrostatic latent image can also be achieved with liquid, rather than dry developer materials. In conventional liquid development, more commonly referred to as electrophoretic development, an insulating liquid vehicle, having finely divided pigmented particles dispersed therein, contacts the imaging surface in both charged and uncharged areas. Under the influence of the electric field associated with the charged image pattern, the suspended particles migrate toward the charged portions of the imaging surface, separating out of the insulating liquid. This electrophoretic migration of charged particles results in the deposition of the charged particles on the image surface in image configuration.

An additional liquid development technique is that referred to as "wetting development", or selective wetting as described in U.S. Pat. No. 3,285,741. In this technique, an aqueous developer uniformly contacts the entire imaging surface, and, due to the selective wetting and electrical properties of the developer, substantially only the charged areas of the imaging surface are wetted by the developer. The developer is relatively conductive, having a resistivity generally less than about $10^6$ ohm-cm$^{-1}$, and it has wetting properties such that, the wetting angle, measured when the developer is placed on the imaging surface, is smaller than 90° at the charged areas and greater than 90° at the uncharged areas.

A further technique for developing electrostatic latent images is the liquid development process disclosed by R. W. Gundlach in U.S. Pat. No. 3,084,043 sometimes referred to as "polar liquid development". In this method, an electrostatic latent image is developed by bringing the imaging surface into developing configuration with a patterned developer applicator having a substantially uniform distribution of raised portions or "lands" and depressed portions or "valleys" and containing a relatively non-conductive liquid developer in the valleys, while the lands are substantially free of developer. Development is achieved by placing the developer applicator loaded with liquid developer in the valleys in developing configurations with the imaging surface. The liquid developer is attracted from the valleys of the applicator surface in the charged or image areas only, thereby rendering the latent image visible. Generally to provide maximum image density it is preferred to place the raised portions of the applicator surface in slight or gentle contact with the imaging surface provided that the raised portions are substantially free of liquid developer.

Any suitable applicator surface may be employed which has a substantially uniform pattern of raised portions and depressed portions provided that the depressed portions are sufficiently large to hold developing quantities of liquid developer therein. To minimize wear on the imaging surface it is preferred to provide raised portions which are uniformly curved or substantially flat on the surfaces which contact the imaging surface.

Typical applicator surfaces include, among others, porous ceramics, metallic sponge, patterned webs or belts, capillary combs, and cylindrical rolls having surface patterns such as single screw cuts or trihelicoid, pyramidal or quadragravure indentations. To provide good image resolution it is preferred that the applicator surface have a pattern comprising between about 100 and about 300 demarcations of raised or depressed areas per inch. Generally, with more coarse patterns, insufficient resolution is obtained and with finer patterns insufficient loading of developer in the recessed portions is obtained to provide good image density. It is generally preferred to employ a pattern of recessed grooves in the trihelicoid pattern since this pattern facilitates better doctoring of the applicator surface.

The applicator surface may be loaded with developer in any suitable manner. Typical developer loading techniques include applying developer from a roll or sponge roll or immersing the applicator in a bath. Prior to contacting the imaging surface, the applicator surface should be wiped or "doctored" clean to remove substantially all liquid developer from the raised portions of the applicator surface. Any suitable means may be provided as the doctoring device. Typical doctoring devices include scraper blades and squeegee rolls. The doctoring in addition to removing liquid developer from the raised portions of the applicator surface preferably provides a slight wiping action of the liquid developer in the recessed portions of the applicator surface to thereby maintain the level of the liquid developer in the recessed portions slightly below the level of the raised portions. Such a loading of developer on the applicator surface minimizes deposits in the non-image areas.

Unlike electrophoretic development systems, polar liquid development avoids substantial contact between the polar liquid developer and the uncharged areas of the image bearing surface. Reduced contact between the liquid developer and the non-image areas of the surface is desirable because the formation of background deposits is thereby inhibited. Another characteristic which distinguishes the polar liquid development technique from electrophoretic development is the fact that the liquid phase of a polar developer actually takes part in the development of a surface. The liquid phase in electrophoretic developers functions only as a carrier medium for developer particles.

Polar liquid development has certain advantages over dry development, such as in requiring fewer moving parts and a similar developer station. Although good high-contrast image quality is obtainable, it has the drawback of being an all-or nothing development process. No simple way is known to vary the contrast density of the image or to extend the range of potentials which may be developed by a given apparatus and developing liquid. Therefore, it would be desirable to provide a system for electrographic reproduction of an original employing polar liquid development techniques with the capability of producing prints which have different contrast gradations, but substantially maximum print density as compared to the original.

Accordingly, it is an object of the present invention to provide methods which provide the above-noted improvements.

It is another object of the present invention to provide apparatus for obtaining electrostatographic copies of adjustable contrast density.

These, as well as other objects, are accomplished in the present invention, which provides a method and apparatus for the production of electrostatographic prints of varying contrast density from an electrostatic latent image. The apparatus of this invention comprises:

a. means for forming a latent electrostatic image on an electrostatographic surface;

b. means for bringing the electrostatic image into developing configuration with a patterned applicator containing polar liquid developer to produce a developed image; and c. means for varying the contact time between said electrostatic image and said liquid developer applicator to thereby change the amount of liquid developer deposited on the surface areas of relatively low potential to a significantly greater extent than the amount of liquid developer deposited in areas of relatively high potential.

When the electrostatographic surface is a re-usable photoconductive surface, the apparatus should also have means for contacting the developed image with a receiving substrate to thereby transfer the developed image from the photoconductive surface to said receiving substrate.

Correspondingly, the method of the present invention involves forming an electrostatic latent image on an electrostatographic surface; and bringing the latent image into developing configuration with a patterned applicator containing polar liquid developer for a period sufficient to render the latent image visible; the period being such that variations in image contrast, without major loss in maximum image density, are obtained.

This invention will become more apparent from the following specification and discussion of the drawings in which.

Figure 1:
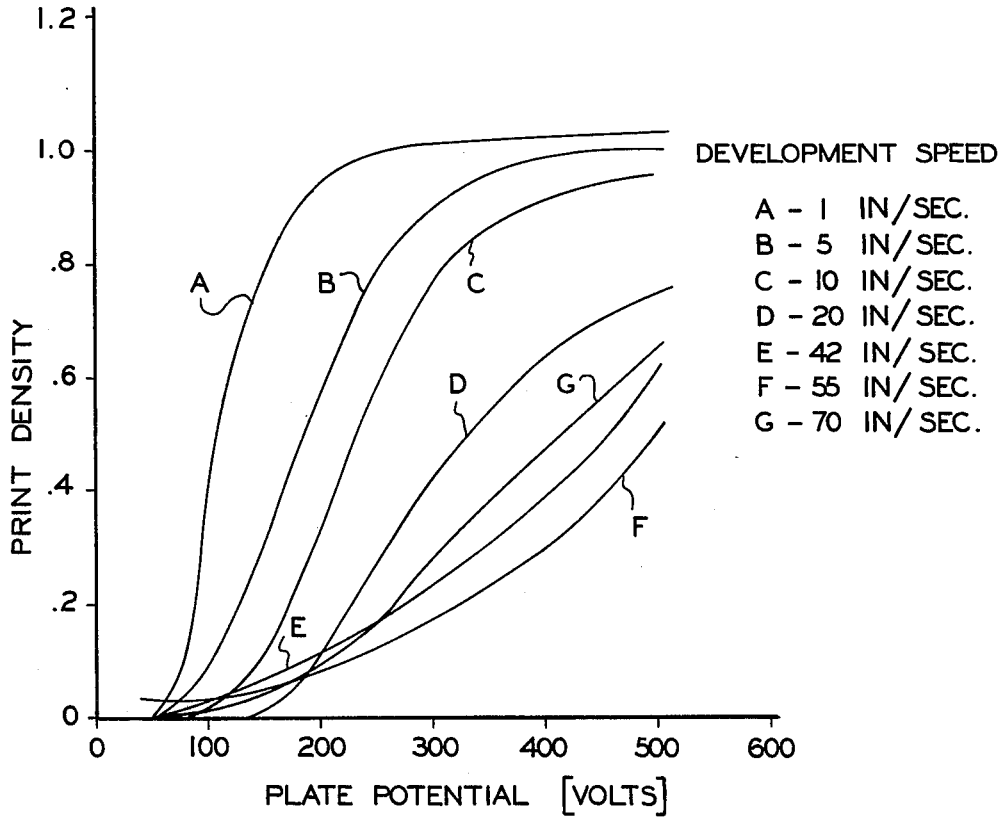
FIG. 1 is a graph of print density versus plate potential showing the development characteristics for a given photoconductor at various development speeds.

In the following description, the liquid developer includes both solutions and dispersions of a colorant, and the "electrostatographic surface" is used to mean an insulating surface capable of holding a charge. Development of an electrostatic latent image according to the technique described herein may be practiced on any imaged electrostatographic imaging surface. Basically, any surface upon which an electrostatic charge pattern may be formed or developed, may be employed. Typical electrostatographic imaging surfaces include dielectrics such as plastics and plastic coated papers, and photoconductors. Photoconductors which may be employed typically include selenium and selenium alloys, cadmium sulfide, cadmium sulfoselenide, phthalocyanine binder coatings and PVK (i.e., polyvinyl carbazole) optionally sensitized with 2,4,7-trinitro-fluorenone. The electrostatographic imaging surface may be used in any suitable shape including plate, belt or drum shape and it may be formed by coating a reservoir dispersion of either a photoconductor or a dielectric on a substrate. The imaging surfaces may be overcoated with a protective dielectric coating in the conventional manner.

The present invention is based upon the discovery that, when polar liquid development is used, print density corresponding to areas of the imaged surface charged to less than a maximum potential will vary in approximate proportion to the reciprocal of the speed of development. Therefore, by varying the time in which the liquid developer applicator is in developing configuration with the imaged surface, one can vary print density in areas of less than maximum print density usually without significantly reducing density in areas of maximum print density.

Contrast levels can be lowered where it is desirable to do so to obtain better image fidelity, as in the reproduction of continuous tone originals; or raised, where it is desirable to do so, as in the case of reproduction of alphanumeric documents, line drawings, etc. This can be accomplished in accordance with the present invention by simply varying the speed at which the imaged surface passes through the liquid development apparatus, with other factors (e.g., potential, exposure, and ink composition) remaining constant. For example, this capability can be used to advantage in the reproduction of engineering drawings where portions are drawn with hard and soft lead, or where the drawing is smudged. A high contrast setting (low development speed) could be used to optimally reproduce both the light and dark lines without reproducing the smudges.

High image contrast (gradation up to 5.0 or more, depending on how it is measured) may be achieved by developing at low development speeds, and low image contrast (gradation of 1.0 or less) may be achieved by developing at high development speeds, using typical photoconductors and polar liquid developers. Image contrast (or "gradation") is defined as the incremental change in image density per change in $\log_{10}$ exposure, averaged over the density range where this change is approximately linear. For a given $\log_{10}$ exposure difference, the image contrast is proportional to the corresponding difference in optical density of the image, optical density being defined as $-\log_{10}$ (reflectance) on the final imaging sheet and being roughly proportional to the mass density/cm$^2$ of liquid developer deposition. In other words, the higher the image contrast, the greater the optical density differences, and, in the case of continuous tone originals with large solid areas, the lower the fidelity of the image to the original.

The range of exposures (on a log 10 basis) over which useful variations in print density can be achieved, is known as the "dynamic range". The larger the dynamic range, the wider the latitude of effective exposures and the less critical is the exposure to the achievement of prints with useful variations in image or print density.

Useful contrast variations occur only up to a particular development speed, beyond which, maximum print density will be substantially lowered. The limiting development speed will be determined by the maximum charge density that can be applied to the electrostatographic surface, which in turn, will be determined by one of the following:

1. Occurrence of air breakdown between the surface and the liquid developer applicator, which is particularly a limitation with thicker electrostatographic films.
2. Maximum field that the electrostatographic surface can support, which is a limitation with thinner films.

For example, in the case of a fifteen micron selenium photoconductor with a 0.5–5 poise mineral oil based polar liquid developer at development speeds of 1 to 10 inches per second, contrast changes with development speed, without significant loss of maximum print density. However, air breakdown occurs at about 500 volts on this photoconductor and, therefore, maximum density, can not be attained above about twenty inches per second. On a 10 micron selenium photoconductor, no air breakdown is observed at 500 volts but this film would only support a charge of about 40 volts per micron, so that maximum print density can not be attained at development speeds above about 20 inches per second. Similarly in a case of a six micron PVK photoconductor, substantially the same range of development speeds i.e., one to twenty inches per second is useful in obtaining a variation in contrast density without substantial loss in maximum print density. The PVK film gives a d/k value (i.e., thickness/dielectric constant) of about 2 microns or roughly the same as that of a 12 micron selenium photoconductor.

The change in contrast which is observed over a range of development speeds is theorized to occur because the amount of ink deposited on the imaged electrostatographic surface varies with the viscosity of ink and the time allowed for development (controlled by development speed) for given potential levels of the surface. Thus an imaged surface has a range of potentials in imagewise configuration, the potential at a given point being dependent upon the log exposure of the imaged surface at that given point. The higher the density of the original, the higher the potential to which the surface is charged, and when an oppositely charged liquid developer is applied to the imagewise discharged photoconductor, the amount of liquid developer which is attracted to the photoconductor is governed by the development time, the developer viscosity and photoconductor potential. Keeping liquid developer viscosity and development time constant, the higher the potential of the photoconductor at a given area, the greater the amount of liquid developer which will be attracted to the imaged surface.

The rate of liquid developer deposition from applicator to charged electrostatographic surface depends upon the force exerted by the surface upon the liquid developer. Therefore, the time allowed for development (controlled by development speed) determines the amount of developer deposited on the surface, which in turn determines the contrast of the developed image. Accordingly, since development rate is a function of potential of the imaged surface, the higher the potential, the sooner the maximum print density is attained. As the development speed is increased, the time allowed for development may be sufficient to substantially attain maximum density in areas of high surface potential but not in areas of lower surface potential.

Turning to the graph of FIG. 1 where plate potential is plotted against print density (i.e., optical reflection density minus optical reflection density of paper without image) over a range of development speeds, using a typical liquid developer having a viscosity of 10 poises, it can be seen that the gradation (shown by slopes of the curves) falls off as development speeds increase from 1 to 20 inches per second. However, maximum print density is substantially attained at development speeds of from 1–10 inches per second, although progressive loss of maximum print density is noted as development speeds approach twenty inches per second. A very significant loss in maximum print density is observed at development speeds of 70 inches per second and greater. Since air breakdown occurs at about 500 volts the voltage could not be increased on this photoconductor sufficiently to substantially attain the maximum density above about 20 inches per second. However, this curve clearly shows that in a case of this photoconductor, by varying the development speed within the range of 1 to 10 inches per second, substantially the maximum print density could be substantially attained along with variations in print contrast.

Figure 2:
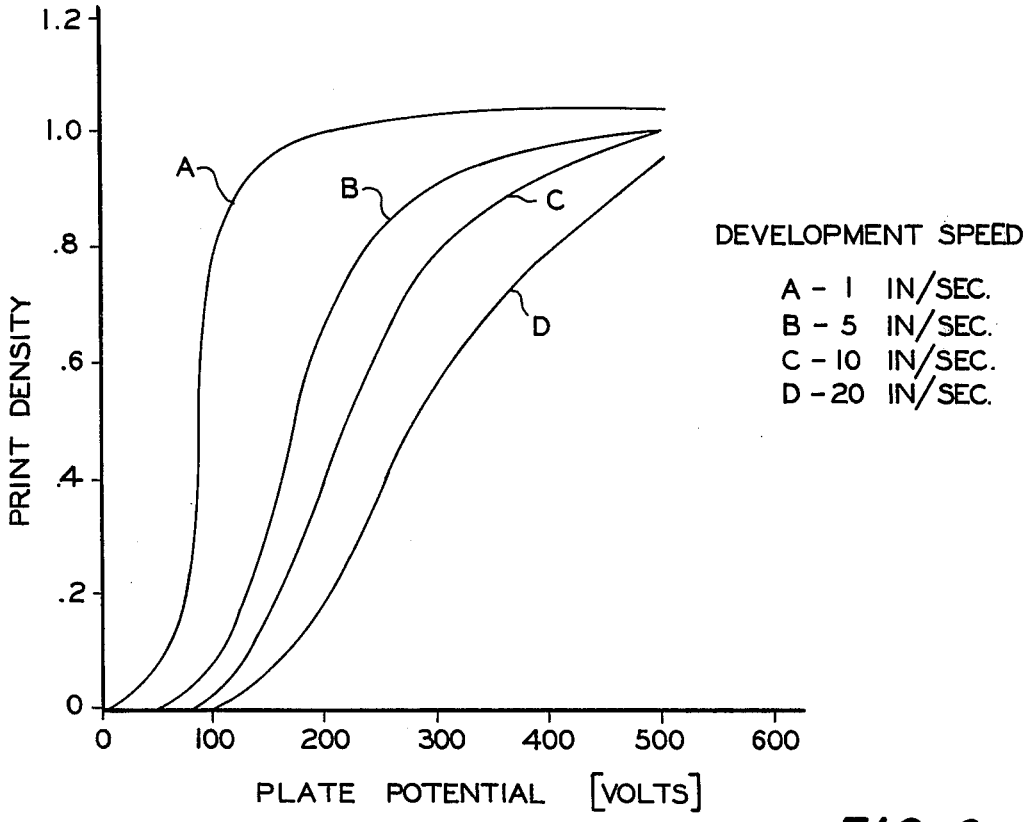
FIG. 2 is a graph of a print density versus plate potential showing development characteristics for another photoconductor at various development speeds.

In FIG. 2, showing the development characteristics for a PVK photoconductor, maximum print densities were substantially attained at development speeds ranging between 1 and 20 inches per second. The resultant prints were characterized by different contrasts as shown by the difference in the slope of all the curves.

Figure 3:
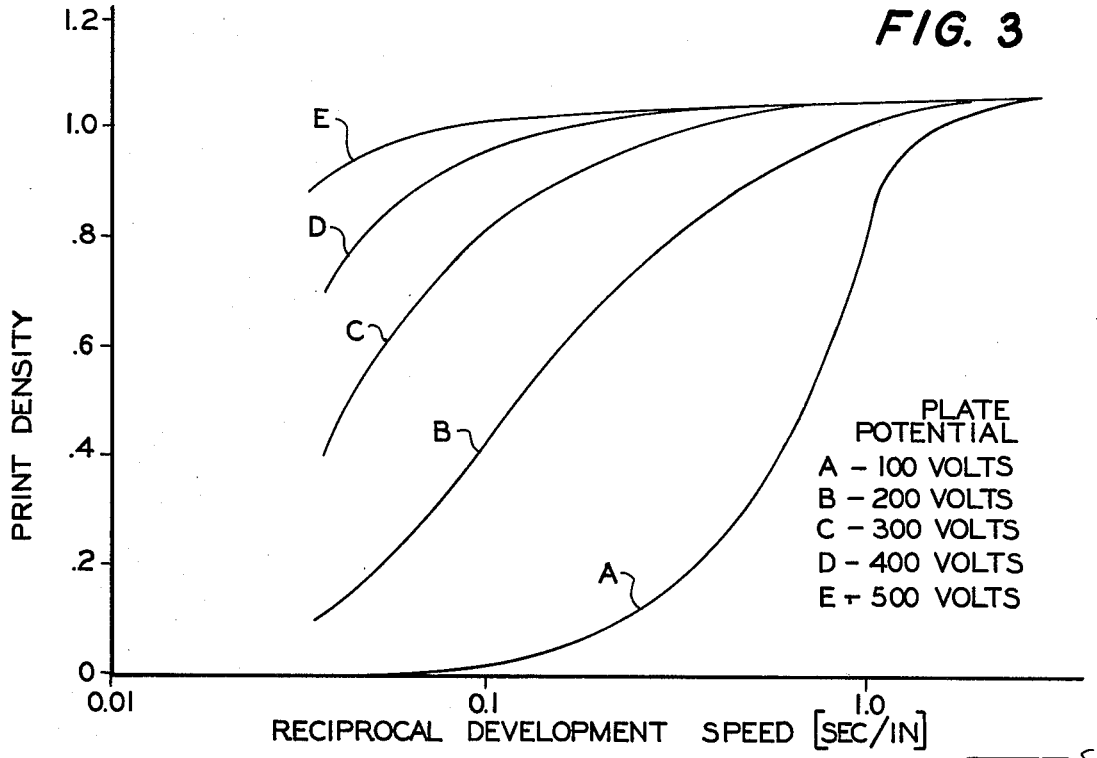
FIG. 3 is a graph of print density versus reciprocal development speed showing the development kinetics for the photoconductor of FIG. 2.

FIG. 3 shows the development kinetics of the PVK photoconductor which was used in obtaining the data for FIG. 2. It shows the time required for development of areas of different potential on the photoconductor surface. As the surface potential decreases, the time required for attainment of maximum print density increases. Thus, as development speed is increased, areas of relatively low potential are not developed to maximum density whereas, up to certain development speeds, areas of high surface potential are fully developed. It is this behavior which is responsible for the contrast variation with development speed without a significant variation in maximum print density.

Figure 4:
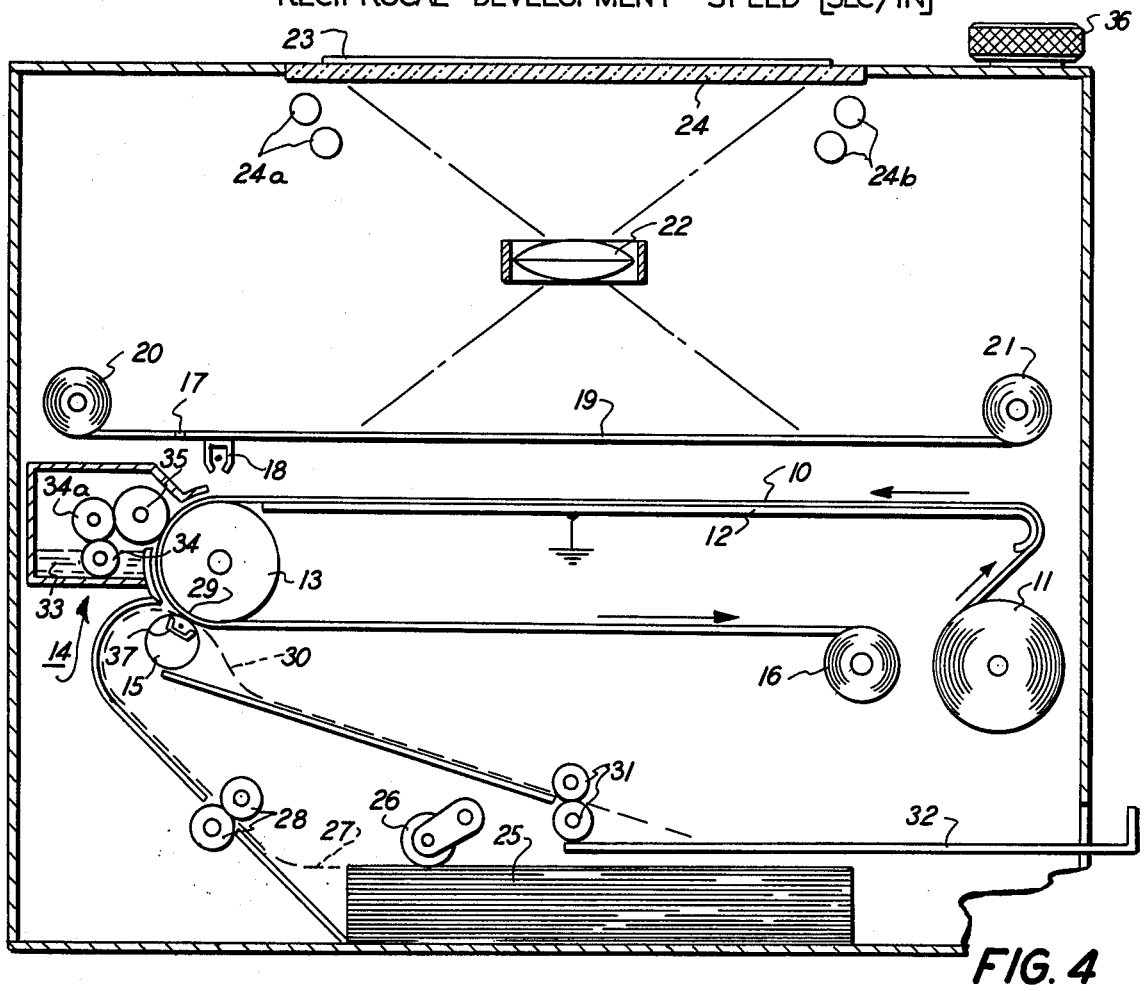
FIG. 4 is a schematic representation of one embodiment of an electrostatographic apparatus operating in accordance with the present invention.

Referring now to FIG. 4, there is illustrated a continuously operating electrostatographic apparatus employing a photoconductive web 10 fed from supply roll 11 over grounded imaging guide 12 around guide roll 13 past developer station 14, transfer roller 15 and onto take-up roll 16. The photoconductor comprises a support having on its surface a photoconductive layer such as for example, PVK. The photoconductive layer is moved passed imaging, developing and transfer stations for image and print formation. Positioned over photoconductor 10 and imaging guide 12 is a traversing imaging slit 17 charging member 18 consisting of a high voltage corona discharge electrode which is generally adapted to supply a uniform charge to photoconductor 10, mounted on a flexible light shield 19 which is drawn between rollers 20 and 21 over the area generally above imaging guide 12. An optical system 22 capable of transmitting a light image of original document 23 is generally disposed under exposure station 24 and over imaging guide 12. Copy material which may be a sheet of paper or a continuous paper web is removed from copy material supply source 25 by pick-off roller 26 and fed along path 27 through guide rolls 28, into contact with photoconductor 10 at transfer point 29, along path 30 to take-off rolls 31 and then to collection station 32.

An original document is reproduced in the following manner. The document is placed at transparent exposure station 24 and flooded with light from light sources (24*a* and 24*b*). Roller 21 is rotated in a counterclockwise direction causing imaging slit 17 and 18 to be drawn from their positions close to roller 20 across the portion of the photoconductor resting on imaging guide 12. As imaging slit 17 and charging member traverse the path between rolls 20 and 21, the charging member 18 imparts a charge to the photoconductor surface and the light image of the original document is projected by optical system 22 through imaging slit 17 onto photoconductor 10. The charged photoconductor is thus discharged in imagewise configuration. The portion of the photoconductor bearing a latent image is moved into developing configuration with developer station 14 by actuation of variable speed drive means (not shown) in driving relationship with photoconductor take-up roll 16. The development station consists of liquid developer supply 33, liquid developer supply rolls 34 and 34*a* and patterned developer applicator 35. The developer applicator has about 250 recessed grooves per inch in a trihelicoid pattern and is in gentle contact with the photoconductor surfaces and liquid developer supply rolls 34 and 34*a*. As the developer-loaded applicator is moved into developing configuration, liquid developer is electrostatically attracted from the recessed portions of the applicator to the charged areas of the imaged photoconductor thus rendering the latent image visible. If the developer applicator is biased with a voltage of the same magnitude and polarity as the charged areas of the photoconductor the developer will move from the developer applicator to the discharged areas of the photoconductor thus producing a negative image where the original subject matter was in positive form. On the other hand, if the developer applicator is biased with a voltage of the same polarity and magnitude as the residual charge on the discharged areas of the photoconductor, liquid developer will transfer to the charged areas of the photoconductor thus producing a positive image where the original subject matter was in the positive form.

Varying the time during which the imaged photoconductor is in developing configuration with the developer applicator, to produce variations in contrast, without significant variation in maximum image density, can be accomplished by providing variable speed drive means to rotate photoconductor take-up roll 16. A control knob 36, accessible to a user of the apparatus, provides the means whereby the speed of development can be adjusted to produce the desired contrast variations. The knob may be imprinted to show that when it is turned in the direction corresponding to increased development speed, prints of lower contrast will result, and when turned the opposite direction corresponding to decreased development speed, prints of higher contrast will be produced.

As the imaged belt is moved passed the developer station, the visible or "developed image" is brought into contact with the copy material at point 29 by pressure applied through transfer roll 15 against guide roller 13. A bias voltage of the same polarity as the charged photoconductor is optionally applied to roll 15 by means of transfer charging member 37. A major portion of the developed image on the photoconductive surface is thus transferred to the copy material, forming a printed image thereupon. The copy material is conducted along path 30 through rolls 31 to collection station 32.

If a print which is thus obtained is found to have a contrast which is undesirable, a second copy can be prepared at a different development speed. If the first copy has too much contrast or an undesirable contrast level, this can be corrected in subsequent copies by adjustment of the development speed through manipulation speed control knob 36. To decrease contrast level, the rate of movement of the photoconductor passed the developer station (i.e., the development speed) is increased. To increase the contrast, the development speed is decreased. By variation of the developmment speed one can prepare prints with substantially maximum density and optimal contrast level.

Although the invention has been specifically described with reference to a continuously operating electrostatographic machine employing a belt bearing a photoconductive surface, the invention is equally applicable and suitable for use with any electrostatographic imaging surface of any suitable configuration including drums, webs, belts or plates. Any surface which is capable of receiving and holding a charge pattern for a short period of time can be suitably employed. Typical materials include selenium, selenium alloys and binder compositions comprising zinc oxide, cadmium sulfide, cadmium sulfoselenide, and the organic photoconductors including phthalocyanine binder coatings and PVK.

Any polar liquid developer materials such as those disclosed in U.S. Pat. No. 3,084,043 are suitable and can be employed herein. To provide the proper charge induction the developer preferably has a resistivity of less than about $10^{14}$ ohm-cm and may be selected from the classes of materials used in polar liquid development. A pigment may be suspended or dispersed within the vehicle or the vehicle may contain dye dissolved in it or both. Pigmented developers in general provide better density and have better archival permanence. Desirably, the particular developers selected should have a relatively long shelf life and be compatible with the particular materials with which they come in contact during the development operation. The liquid developer should have a viscosity under development conditions (in which the shear rate is approximately in the order of 100 to 1000 $sec^{-1}$) of about 3 to 30 poises. Preferably, the developer should wet the applicator grooves to permit uniform application. Generally, the liquid developers of the present invention are capable of being selectively attracted from the developer applicator in response to the charge pattern on the electrostatographic surface with substantially no particle separation or migration out of the insulating medium. Typically, the liquid developers that may be employed are selected from the commercially available water and oil based inks, and include, among others, as vehicles mineral oil, oleic acid, polypropylene glycol, 2,5-hexanediol, glycerol, sorbitol, vegetable oils such as castor oil, peanut oil, sunflower seed oil, rapeseed oil, corn oil, olive oil. Additional typical vehicles include aliphatic hydrocarbons such as mineral spirits, kerosene, petroleum naphtha; aromatic hydrocarbons such as benzene, toluene and xylene; and esters such as butyl stearate and butyl oleate.

These liquids may be employed with or without colorant materials. A particular application for the use of these materials without a colorant would be in a process involving secondary development by a powdered or coated colorant. Generally, however, it is preferred to employ colored liquid developers. Many suitable colorants are disclosed in commonly assigned U.S. Pat. No. 3,502,582. These include carbon black, charcoal, iron oxide, ultramarine blue, zinc oxide, titanium dioxide, methylene blue, methyl violet tannate, and benzidine yellow. The liquid developer may also contain a dispersant such as alkylated polyvinyl pyrrolidone to aid in dispersion of the pigment in the vehicle and to promote absorption of the developer into the paper to which the developed image is transferred. In addition, resins such as nitrocellulose and the ester gums may be added to impart smudge resistance to the transferred print.

Although specific materials and conditions are set forth, they are merely intended as illustrations of the present invention. Various other electrostatographic imaging surfaces, liquid developers and reproduction techniques may be substituted with similar results.

Other modifications of the present invention will occur to those skilled in the art upon a reading of the present disclosure. These are intended to be included within the scope of this invention.

What is claimed is:

1. Apparatus for the production of an improved electrostatographic copy from an electrostatic latent image comprising:

a. means for forming an electrostatic latent image on a moving electrostatographic surface;

b. means for bringing the electrostatic image into developing configuration with a patterned applicator containing polar liquid developer to produce a developed image; and c. means for varying the contact time between said electrostatic image and said liquid developer applicator by varying the speed of said moving electrostatographic surface to thereby change the amount of liquid developer deposited on the surface areas of relatively low potential without significantly affecting the amount of liquid developer deposited in areas of relatively high potential.

2. The apparatus of claim 1 wherein means are provided for transferring the developed image from the electrostatographic surface to a copy material.

3. The apparatus of claim 1 wherein the electrostatographic surface comprises a photoconductor selected from the group consisting of selenium, selenium alloys, phthalocyanine in a polymeric binder and poly(vinyl) carbazole in a polymeric binder.

4. The apparatus of claim 3 wherein the photoconductor moves at a speed in the range of about 1 to 20 inches per second.

5. The apparatus of claim 1 wherein the means for varying the contact time between said electrostatic image and said liquid developer applicator comprises a variable speed drive means for said electrostatographic surface bearing said electrostatic image.

6. The apparatus of claim 5 wherein the variable speed drive means is actuated by a single speed control which when moved in a direction to increase development speed produces an electrostatographic copy of low contrast and when moved in a direction to decrease development speed produces an electrostatographic copy of higher contrast.

7. The apparatus of claim 1 wherein the electrostatographic surface comprises a photoconductive layer on a web fed from a supply roll to a take-up roll, and the variable speed drive means is in a driving relationship with said take-up roll.

8. The apparatus of claim 1 wherein the electrostatographic surface comprises a photoconductive layer on a drum, and the variable speed drive means is in a driving relationship with said drum.

9. The apparatus of claim 1 wherein the electrostatographic surface comprises a photoconductive layer on a belt, and the variable speed drive means is in a driving relationship with said belt.

* * * * *